US005452963A

United States Patent [19]

Christensen

[11] Patent Number: 5,452,963

[45] Date of Patent: Sep. 26, 1995

[54] CROWD CONTROL BARRIER

[76] Inventor: Marc E. Christensen, 20805 Lowell Rd., Caldwell, Id. 83605

[21] Appl. No.: 278,495

[22] Filed: Jul. 20, 1994

[51] Int. Cl.[6] ..... E01F 13/00

[52] U.S. Cl. ..... 404/6; 256/13.1

[58] Field of Search ..... 404/6, 7, 9, 10, 404/12, 13; 256/1, 13.1

[56] References Cited

U.S. PATENT DOCUMENTS

| | | | |
|---|---|---|---|
| 4,681,302 | 7/1987 | Thompson | 256/13.1 |
| 4,773,629 | 9/1988 | Yodock | 256/13.1 |
| 4,854,767 | 8/1989 | Sasaki | 404/13 X |
| 4,869,617 | 9/1989 | Chiodo | 404/6 |
| 5,011,325 | 4/1991 | Antonioli | 404/13 X |
| 5,123,773 | 6/1992 | Yodock | 404/6 |
| 5,387,049 | 2/1995 | Duckett | 404/6 |

*Primary Examiner*—Ramon S. Britts
*Assistant Examiner*—James A. Lisehora
*Attorney, Agent, or Firm*—Albert M. Crowder, Jr.

[57] ABSTRACT

A portable crowd control barrier for use in sporting or entertainment events having lightweight body members formed of a resiliently deformable material and each defining an interior chamber and having slots formed in endwalls thereof to receive wooden studs such that the introduction of liquid into the interior chambers deforms the body members, clamping the walls of the slots against the studs and locking the system in place.

6 Claims, 8 Drawing Sheets

CROWD CONTROL BARRIER

BACKGROUND OF THE INVENTION

The present invention relates to a portable barrier system, and more particularly, a barrier system for use with outdoor activities such as athletic events which require a predefined field layout or for use with entertainment events having an outdoor stage where a discreet distance between spectators and the stage is desired to be maintained.

In the prior art, portable athletic event barriers have generally been relatively expensive and difficult to erect and disassemble before and after the athletic events. Generally such prior art barriers are of a relatively low height which a spectator might easily step across. The basic function of the prior art devices was merely to outline the area of play and the area beyond which it was desired to maintain control of spectators. Additionally, the prior art also describes various embodiments of highway and construction barriers one of which is the New Jersey style barrier.

The New Jersey style barrier has a relatively wide base having side walls which extend upwardly from the pavement a short distance; thereafter the walls of the barrier extend upwardly and inwardly for a distance; and finally, the upper portion of the barrier extends upwardly in a vertical plane. In the past, the barriers were made of poured concrete. The disadvantages of this was occasioned by the high weight which occasioned special equipment for handling the barriers. More recently, however, the highway barriers have been made from a semi-rigid plastic material having an opening to permit liquid to be introduced into the interior to give weight or ballast and an opening near the bottom to permit the liquid to be drained in order that the barriers might be easily moved for relocation.

One disadvantage of these later barriers was the intricate means of interlocking one barrier end onto another such that problems were occasioned by production molding of the barriers. Additionally, one type of barrier required lifting and sliding the ends into interlocking relation while other barrier types required use of a metal pin or post to join them. Further, the construction type barrier is generally not of a configuration and height to be conveniently used in spectator type situations.

SUMMARY OF THE INVENTION

It is an object of this invention to provide a crowd control barrier which is relatively light in weight for ease of transportation and which provides sufficient height to control access of a crowd to the playing or entertainment area while permitting the spectators to easily view the event. It is also an object of the present invention to provide a crowd control barrier which may be easily positioned in the desired configuration and rigidly locked into place.

The above objects are provided by the crowd control barrier of the present invention which comprises an elongated hollow container having a base portion, having a first vertical side wall extending upwardly perpendicular to the base portion a predetermined distance, a second vertical side wall extending upward a lesser distance, and a third vertical side wall thereafter extending upward in an inwardly sloping direction and a top portion joining the upper extremities of the first side wall and the third or sloping side wall. Additionally, end walls are provided to enclose the unit and a means to allow it to be filled with a liquid and a means to discharge the liquid are formed into the unit. Further, two cylindrical recesses are formed in the top portion, perpendicular thereto and extending into the interior of the unit to permit a net or the like to be placed above the unit for added safety or security.

A pair of recesses are formed into the base unit to permit use of a forklift in moving and arranging the unit. Further, a pair of spaced-apart slots are formed in each end wall such that they may be placed over a section of a standard dimension wooden board such as a 2"×4" stud having a predetermined length. When placed into position over the 2×4 studs and abutted end to end with another unit, filling the unit with a liquid causes the semi-rigid plastic material to deform slightly clamping the 2×4 studs into place and providing a locking means for the system.

DESCRIPTION OF THE PREFERRED EMBODIMENT

Figure 1:
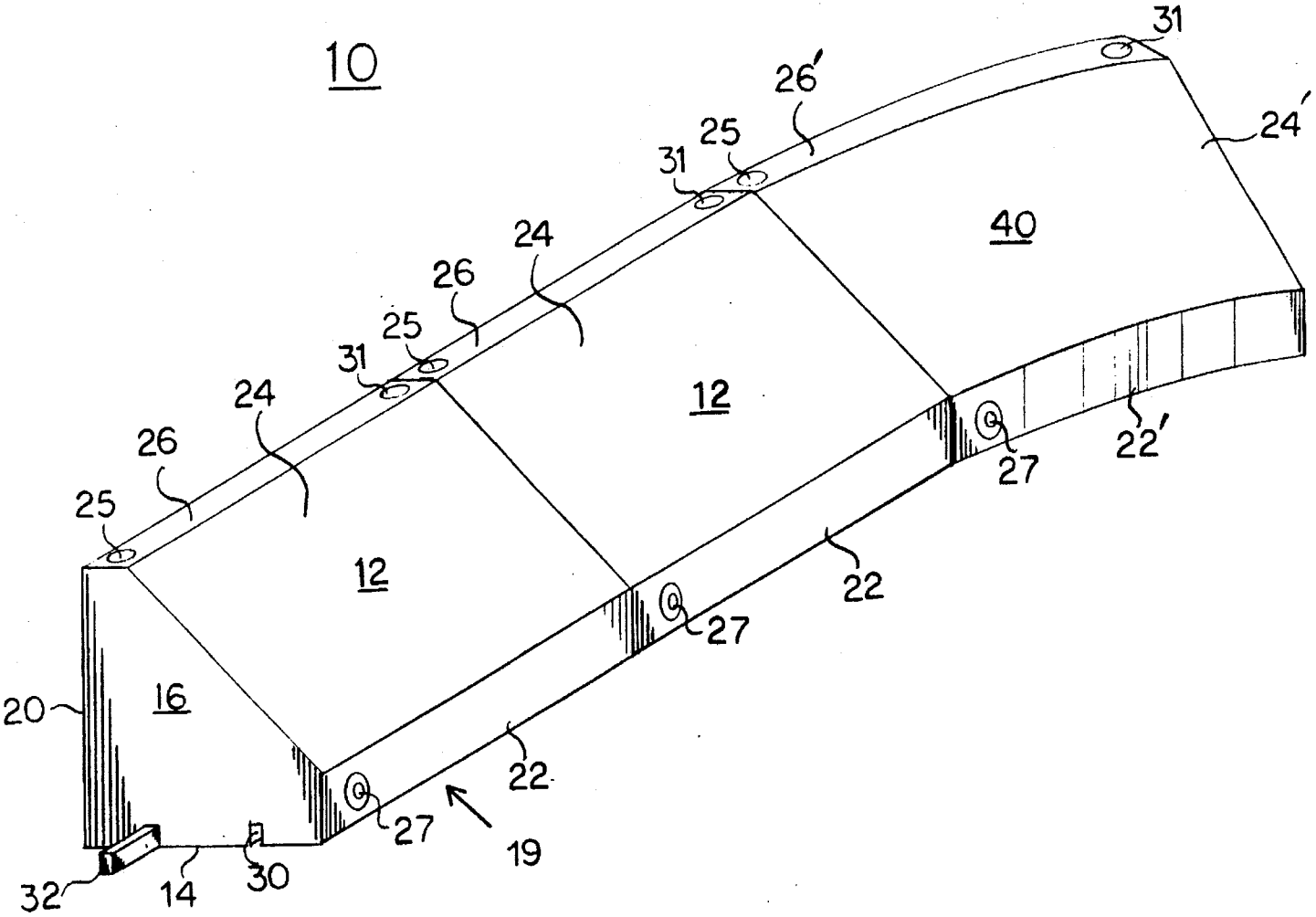
FIG. 1 is a perspective view of the crowd control barrier of the present invention.

Referring now to FIG. 1, the barrier system 10 of the present invention includes a number of straight control barrier units 12 and a curved control barrier unit 40 joined together in a manner hereinafter set forth. Each barrier unit 12, 40 of the invention comprises an elongated hollow container having a base portion 19 with side walls 20, 22, end walls 16, 18 and a bottom 14. Side walls 20, 22 rise substantially vertical with side wall 20 extending upward a distance greater than the vertical rise of side wall 22. An intermediate wall portion 24 extends inwardly from the upper edge of side wall 22 toward the upper edge of side wall 20. A top portion 26 is joined to end walls 16, 18 and side wall 20 and intermediate wall 24 to enclose the barrier units 12, 40. One embodiment of the present invention envisions a base footprint of 3¾'×5½'×4' in height.

Cylindrical, recessed fill plugs 25,31 are formed in top 26 to permit, when either plug is removed, a liquid to be introduced into the interior chamber of barrier units 12, 40. Additionally, the fill plugs 25,31 are dimensioned to receive a pair of cylindrical uprights (not shown) which may be used to support a net or the like therebetween for added safety or security. Likewise, a recessed drain plug 27 is formed into side wall 22 to permit draining the liquid from the interior chamber of barrier units 12, 40 when it is desired to relocate or reposition the barrier 10.

Figure 2A:
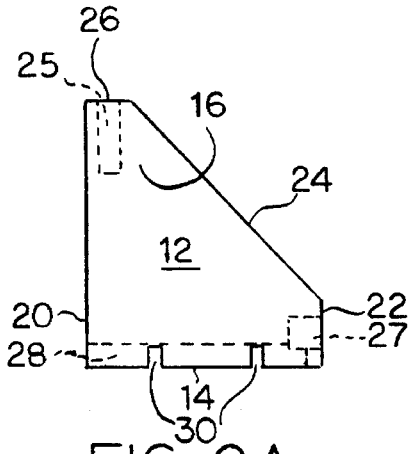
FIG. 2A is an end view of the crowd control barrier of the present invention.
Figure 2B:
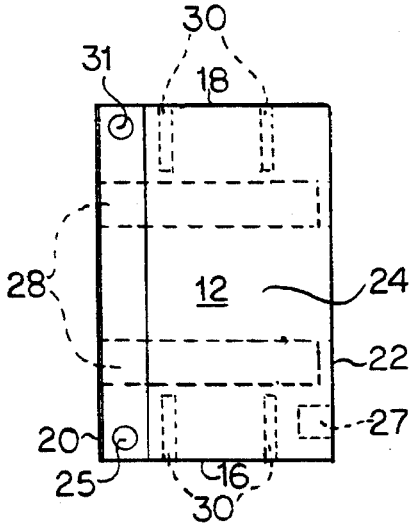
FIG. 2B is a top view of the crowd control barrier of the present invention.
Figure 2C:
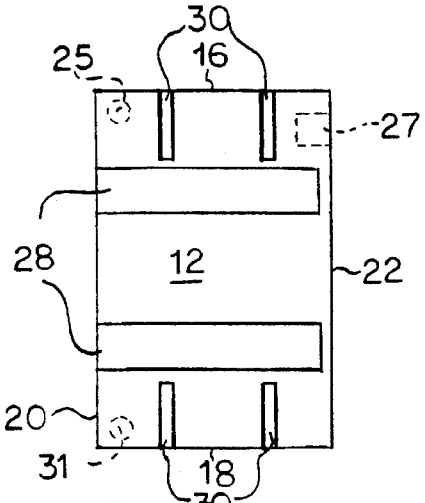
FIG. 2C is a bottom view of the crowd control barrier of the present invention.

Still referring to FIGS. 2A through 2C, a plurality of notches or slots 30 are formed at the juncture of bottom 14 and end walls 16, 18. An equal number of slots 30 are formed in each side wall 16, 18 and extend a predetermined distance from side wall 16, 18 toward the opposing side wall 18, 16 respectively. The slots are further positioned so that when an end 16 is abutted to an end 18 the slots 30 in each end 16, 18 are in alignment. Each slot 30 is dimensioned to receive in relatively snug fit, a standard 2"×4" wood stud or board 32 dimensioned such that when an end wall 18 of one unit 12 or 40 is abutted against an end wall 16 of a second unit 12 or 40, the 2×4 stud 32 positioned in slot 30 will be in snug contact with the surfaces of slot 30.

Figure 3:
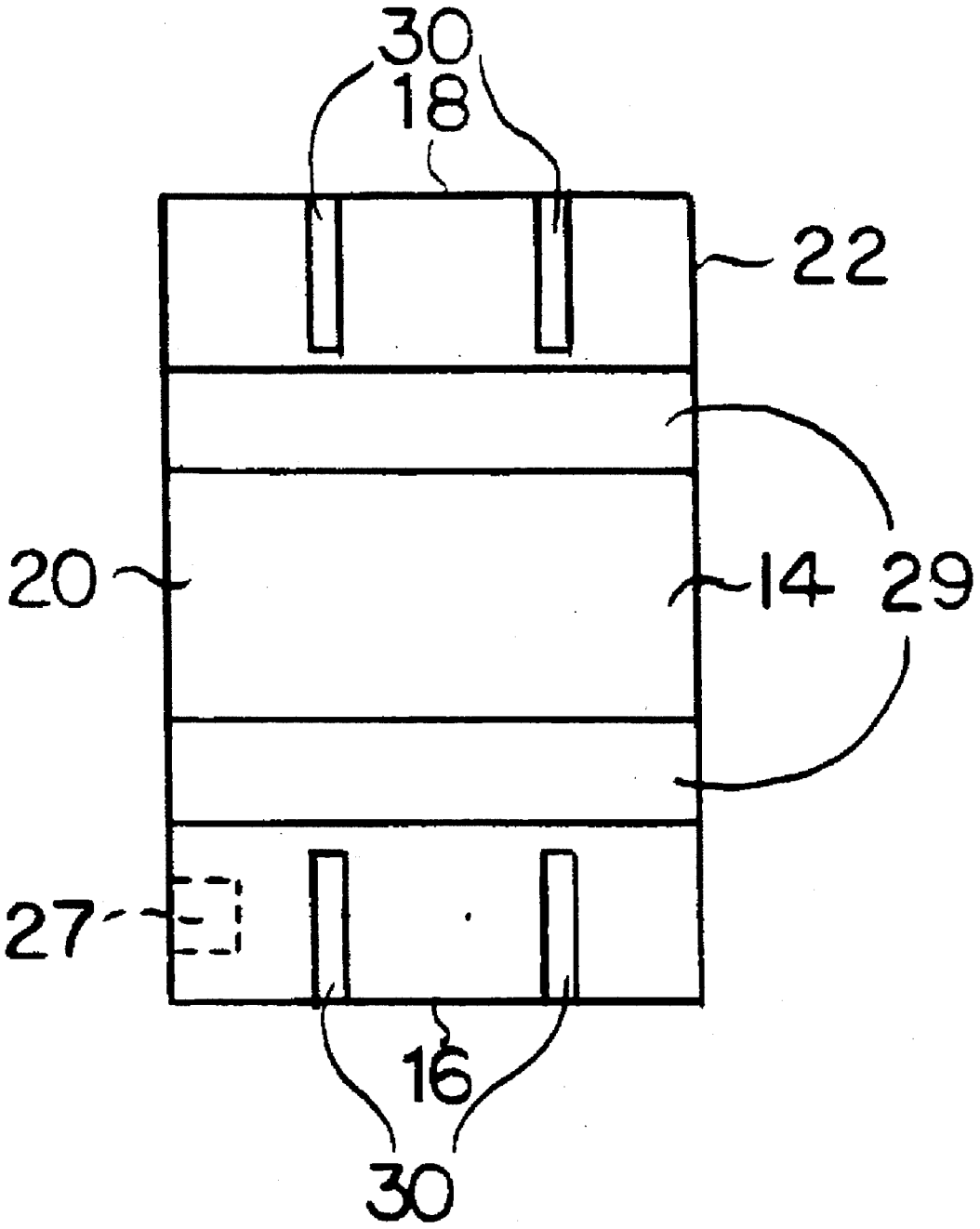
FIG. 3 is a bottom view of an alternate embodiment of the crowd control barrier of the present invention.

Still referring to FIG. 2, a second set of slots 28 are formed at the juncture of bottom 14 and sidewall 22 and extend from sidewall 22 inwardly a predetermined distance toward side 20. The slots are dimensioned and spaced apart in order to receive the tines of a standard fork lift for ease in moving and transporting the barriers. Referring also to FIG. 3, a second adaptation of the fork lift slots 29 are shown extending between side 20 and side 22.

The actual embodiment will be dependent upon the type of activity for which the units 12, 40 are utilized. If the units 12,40 are utilized to delimit the playing field for a game such as hockey or the like which has a relatively small game piece which may inadvertently be knocked into one of the fork lift slots 28, the adaptation depicted in FIG. 2 showing the slots 28 extending from side 22 almost but not completely to side 20 is advantageous in that it presents a solid wall 20 to the playing area. Where, however, the playing piece used is large such as in the case of soccer, or system 10 is used as a barrier for crowd control at an enterprise where no game pieces would be utilized, the embodiment shown in FIG. 3 wherein fork lift slots 29 extend completely transversely through the body of the barriers of 12, 40 would simplify production of the units.

Barriers 12, 40 are made of a resiliently deformable plastic material selected from materials having strong, semi-rigid and energy absorbing properties. The materials are selected from a polymeric group which will deform under internal pressure but will not fail in a brittle manner. In addition, the material is selected to provide a smooth exterior surface on units 12, 40 so as to reduce abrasions from collisions of players or crowds pushing against the barrier 10.

When the term "semi-rigid" is used, it means that the units 12, 40 are made from a material that is capable of allowing a slight flexing when water is introduced into the interior chamber of the units 12, 40. This is in opposition to a rigid material which would hold its shape regardless of the interior loading of the water. As will be hereinafter explained, the flexure under load becomes important to the locking mechanism by which the units 12, 40 are held in place when positioned for use.

In practice, the units 12, 40 while empty of any liquid are relatively light in weight and may be easily transported to the site where they are to be used. The units 12, 40 may then be placed or otherwise positioned in the desired layout at the location where the control barrier 10 is needed. As the units 12, 40 are being positioned, 2×4 studs 32 are placed such that when an end 18 is positioned against and end 16, slots 30 in the abutting units completely cover studs 32.

Figure 4A:
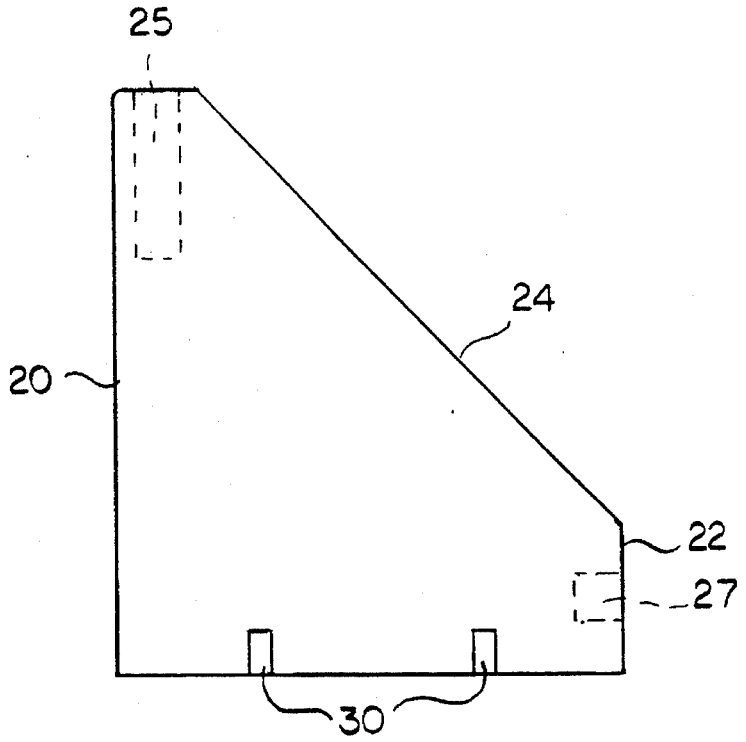
FIG. 4A is an end view the crowd control barrier of the present invention empty of liquid.
Figure 4B:
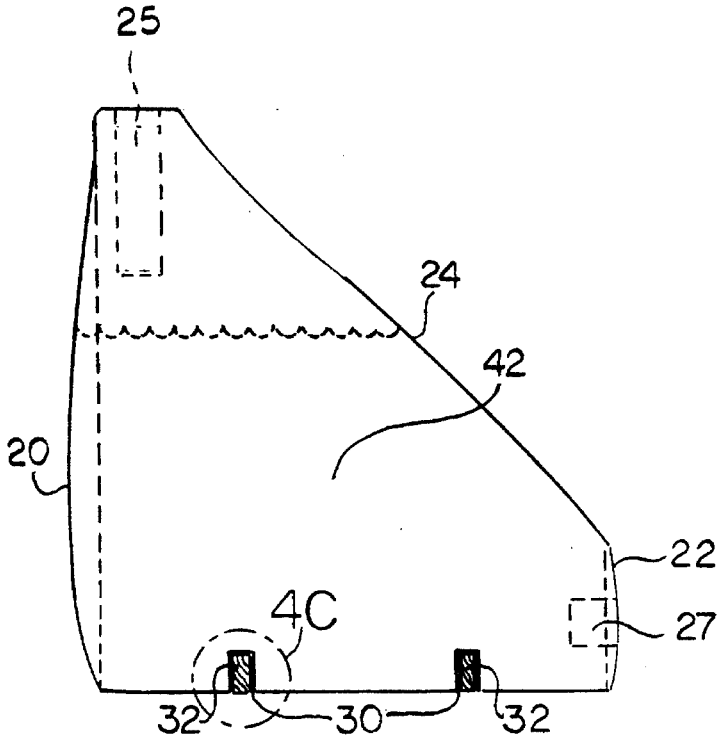
FIG. 4B is an end view of the crowd control barrier with liquid added showing the deformation of the semi-rigid plastic material.
Figure 4C:
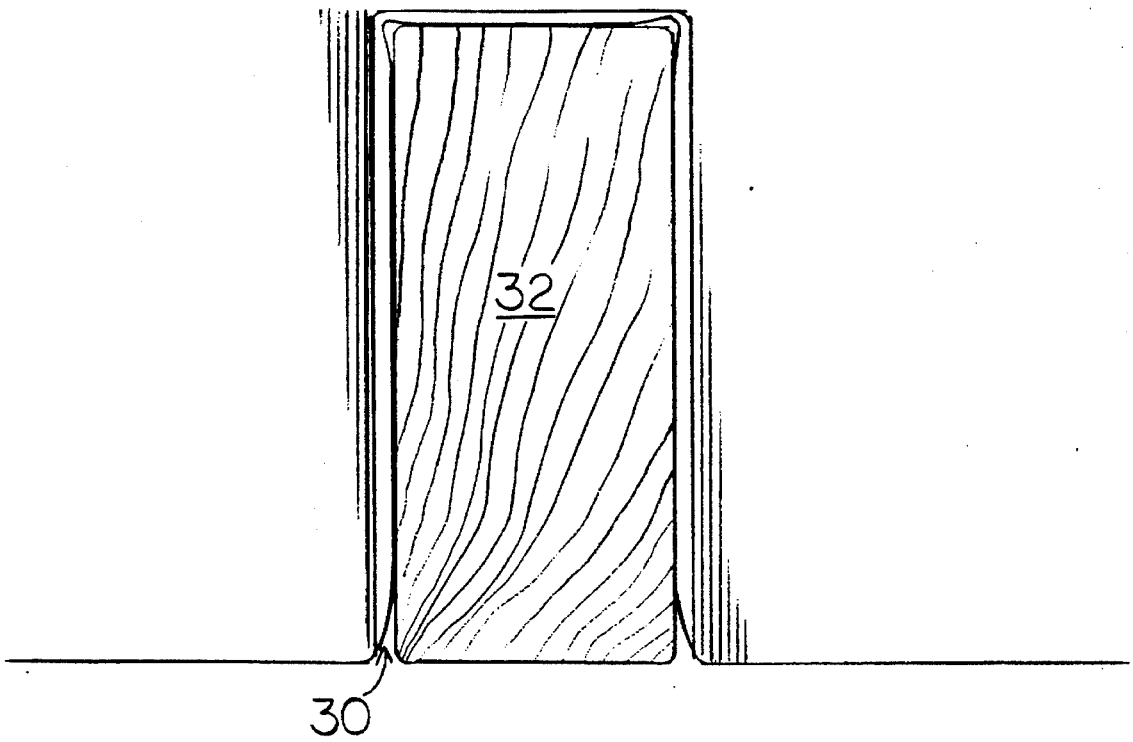
FIG. 4C is a cut out portion of the end view of FIG. 4B showing the deformation of the semi-rigid plastic clamping the 2×4 utilizing and locking the units together.

Once positioned, liquid is introduced into the hollow interiors of units 12, 40. Referring now to FIGS. 4A, 4B and 4C, FIG. 4A shows a unit prior to introduction of liquid into the hollow interior. In this configuration, the control barrier units 12, 40 may be easily moved and repositioned until the desired configuration is obtained. Referring to FIG. 4B, as liquid 42 is introduced into the interior chamber of the barriers 12, 40, the weight of the liquid 42 causes a slight flexure in the vertical walls 20, 22 and 24 of barrier 12, 40. Of utmost importance, however, is the flexure occasioned on slots 30. As the pressure increases, the slot 30 tends to bow out and clamp firmly onto studs 32. Liquid 42 not only adds weight to barriers 12, 40 helping to hold them in place, but also clamps the barriers to the studs 32 so that the normal force of a crowd pushing against the barrier 10 or of a player running into the barrier 10 would not be sufficient to dislodge the units 12, 40 of barrier 10 from their positions.

Figure 5A:
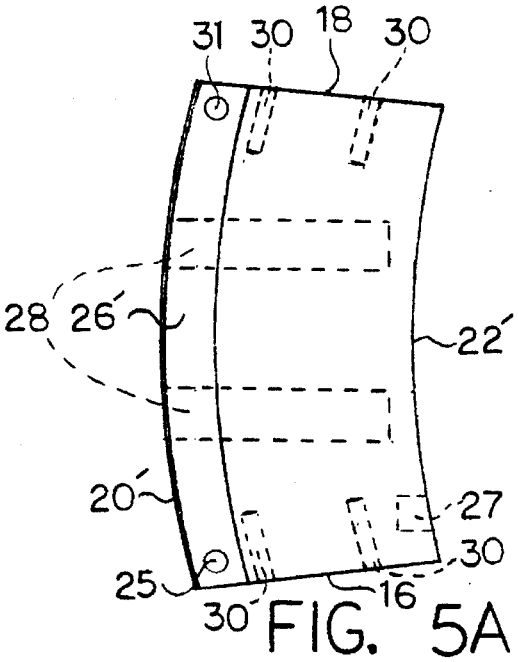
FIG. 5A and FIG. 5B are top and bottom views of a curved embodiment of the crowd control barrier of the present invention.
Figure 5B:
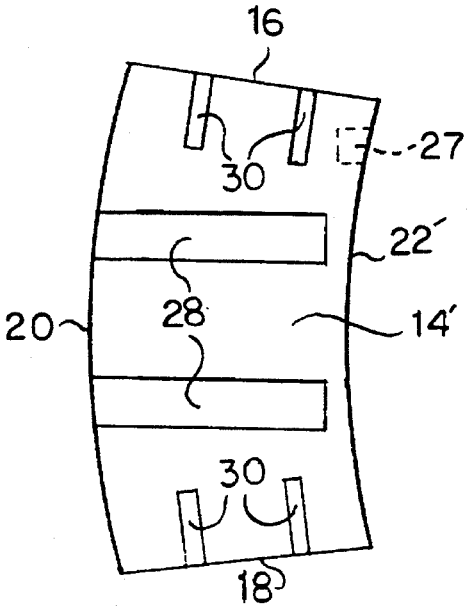

Referring now to FIG. 5, unit 40 is shown having a curved configuration which permits installation of a control barrier 10 in a smoothly flowing curved or circular arrangement. Except for having predetermined curved walls 20', 22' and 24' along with bottom 14' and top 26', formed to join with side walls 20', 22' and 24'. End walls 16 and 18 are identical to end walls 16 and 18 of unit 12. Thus, the construction of unit 40 is identical to that described for unit 12 as had been above indicated.

Figure 6A:
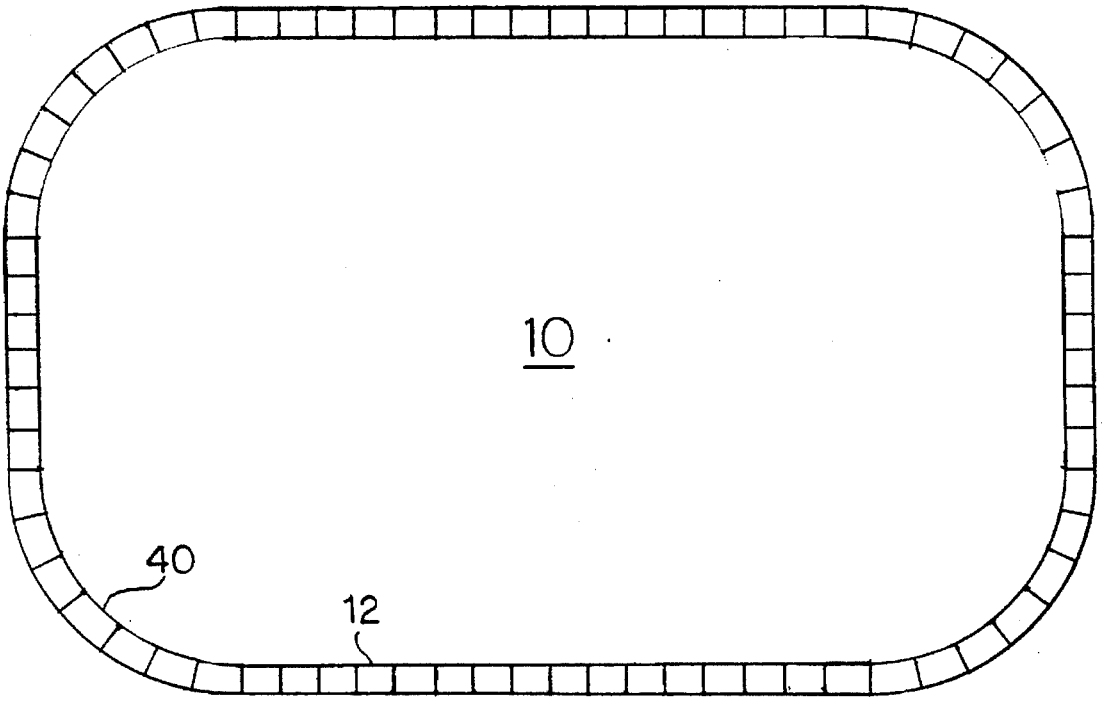
FIGS. 6A, 6B, and 6C are indicative of various emplacements which may be used for various purposes.
Figure 6B:
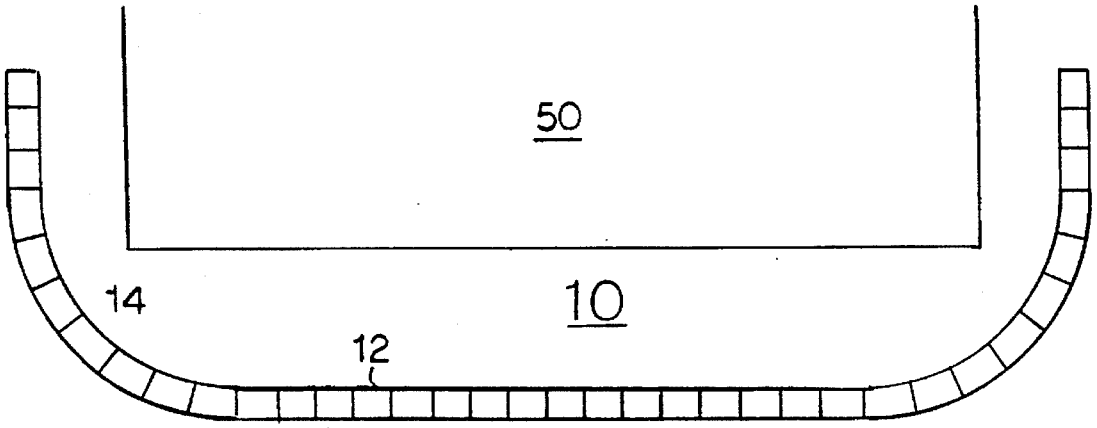
Figure 6C:
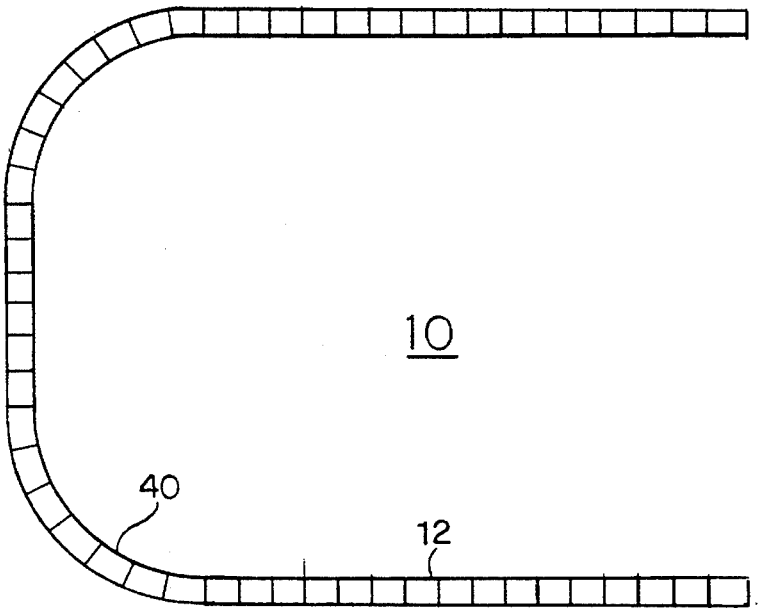
Figure 7:
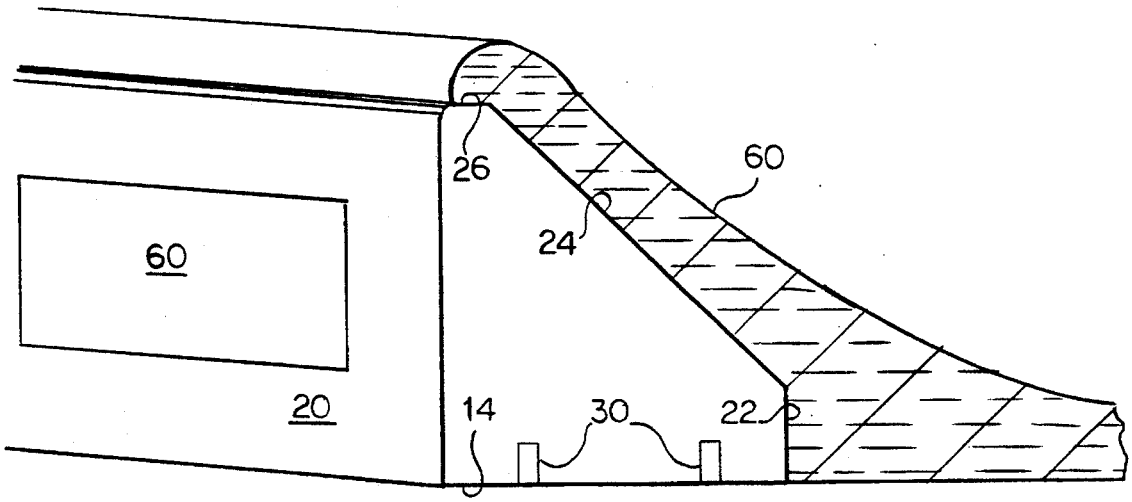
FIG. 7 shows a perspective view of the portion of one of the units of the crowd control barrier of the present invention in a reversed configuration for utilization in a winter sport.

Referring now to FIGS. 6A, B and C, various configurations of the control barrier system 10 are indicated showing the flexibility by which the system can be readily configured. FIG. 6A depicts use of the barrier 10 to provide a playing field layout while FIGS. 6B and 6C depict use of the barrier 10 for crowd control during an event might be presented on a stage.

in addition, referring now to FIG. 7, the barrier system 10 may be utilized in constructing an ice rink or, in view of modern times, a half-pipe configuration for use with snowboards and the like, whereby snow or an ice surface 60 is placed against the sloping surface of units 12, 40 to provide a relatively slick surface to the users.

Still referring to FIG. 7, an inset 60 is shown formed in side 20 of the unit 12. It is envisioned that advertising material may be placed in the inset and covered with a clear cover material (not shown) such as plastic or the like.

Although particular embodiments of the invention have been described herein, it will be understood that the invention is not limited to the embodiments disclosed and that variations can be made therein without departing from the essential features of the invention and the preferred embodiments are not intended to limit the spirit or scope of the invention as set forth in the appending claims.

I claim:

1. A crowd control barrier comprising:

a plurality of transportable hollow enclosed containers made from a lightweight, resiliently deformable material, said containers each having a top, a bottom, ends, a first side extending vertically upward from said bottom to said top, a second side extending vertically upward from said bottom a lesser distance than said first side and a third side extending from the uppermost part of said second side in an inwardly sloping direction to said top, said containers each having filler openings situated in said top with one of said filler openings adjacent one of said ends;

means for coupling adjacent ends of said containers to one another, said coupling means including a pair of slots formed in each adjacent end at a juncture of the adjacent end and the bottom and extending through said bottom and a predetermined distance toward an opposite end and parallel with said first and second sides, each of said slots dimensioned to receive in snug fit a portion of a stud such that when said containers are positioned adjacent one another the slots in each are in alignment and said stud is positioned in the slots formed in each of said containers, wherein introducing a liquid into said containers through said filler openings causes said resiliently deformable material to deform, clamping said stud and locking said containers in position; and a drain formed in said second side of the containers and adjacent the bottom whereby said liquid may be drained from said containers, unclamping said stud and permitting the containers to be separated.

2. The barrier as claimed in claim 1, wherein said filler openings are each dimensioned to receive and support one end of a cylindrical upright having a predetermined length extending vertically upward from said top of said containers, permitting a safety net to be installed whereby the effective height of the barrier is increased.

3. The barrier as claimed in claim 1, including a rectangular indentation formed in the exterior surface of said first side, said indentation having a plurality of fastener anchors, whereby a signboard may be affixed to the containers.

4. The barrier as claimed in claim 1, wherein said first, second and third sides and said top and said bottom of at least one of said containers are curved such that said at least one container forms an arcuate shape, permitting the barrier to be formed in a plurality of configurations.

5. The barrier as claimed in claim 4, wherein said filler openings are each dimensioned to receive and support one end of a cylindrical upright having a predetermined length extending vertically upward from said top of said containers, permitting a safety net to be installed whereby the effective height of the barrier is increased.

6. The barrier as claimed in claim 4, including a rectangular indentation formed in the exterior surface of said first side, said indentation having a plurality of fastener anchors, whereby a signboard may be affixed to the containers.

* * * * *